United States Patent [19]

DeReggi et al.

[11] Patent Number: 4,517,665

[45] Date of Patent: May 14, 1985

[54] ACOUSTICALLY TRANSPARENT HYDROPHONE PROBE

[75] Inventors: Aimé S. DeReggi, Boyds; Gerald R. Harris, Rockville, both of Md.

[73] Assignee: The United States of America as represented by the Department of Health and Human Services, Washington, D.C.

[21] Appl. No.: 553,387

[22] Filed: Nov. 17, 1983

Related U.S. Application Data

[62] Division of Ser. No. 210,044, Nov. 24, 1980, Pat. No. 4,433,400.

[51] Int. Cl.[3] ..... H04R 17/00

[52] U.S. Cl. ..... 367/163; 367/155; 367/165; 367/170; 310/800

[58] Field of Search ..... 367/140, 141, 155, 153, 367/160, 161, 163, 164, 165, 170; 310/365, 330, 366, 331, 800, 332; 179/110 A, 111 E; 307/400

[56] References Cited

U.S. PATENT DOCUMENTS

| | | | |
|---|---|---|---|
| 2,724,818 | 11/1955 | Camp | 367/156 |
| 3,090,030 | 5/1963 | Schuck | 367/164 |
| 3,903,733 | 9/1975 | Murayama et al. | 310/800 |
| 3,935,485 | 1/1976 | Yoshida et al. | 310/800 X |
| 3,940,974 | 3/1976 | Taylor | 310/800 X |
| 4,013,992 | 3/1977 | Dewberry et al. | 367/161 |
| 4,204,135 | 5/1980 | Murayama | 310/800 X |
| 4,315,433 | 2/1982 | Edelman et al. | 310/800 |

OTHER PUBLICATIONS

"Polymeric Ultrasonic Probe" by DeReggi et al., J. Acoust. Soc. of Am., vol. 64, Supp. No. 1, Fall 78, pp. 555 and 556, Abstract U8.

"A PVDF Membrane Hydrophone for Operation in the Range of 0.5 MHz to 15 MHz" by Shotton et al., Ultrasonics, May 1980.

Electromotional Device Using $PVF_2$ Multilayer Bimorph by Todal et al., IECE of Japan, vol. E. 61, No. 7, Jul. 1978, pp. 507–512.

*Primary Examiner*—Harold J. Tudor

*Attorney, Agent, or Firm*—Browdy and Neimark

[57] ABSTRACT

An acoustically transparent hydrophone probe consisting of a rigid hoop structure in which is secured an assembly of very thin piezoelectric polymer sheet material, such as polyvinylidene fluoride, with one or more very small central sensitive portions. In its simplest form it consists of a single sheet with a small central poled piezoelectric area and with very thin metallic electrodes deposited on the sheet on opposite sides of the piezoelectric area and having fine conductive leads extending from the electrodes and adapted to be connected to a suitable amplifier or transmission line. The sheet is of biaxially stretched material, and is held taut in the hoop structure. Other embodiments may employ multiple sheets. With two sheets, the outermost surfaces are metallized and are at common ground potential, and the inner surfaces have superimposed deposited metallic electrodes with poled piezoelectric areas adjacent thereto. The electrodes have superimposed deposited metallic leads which have a common electrical connection to a transmission line or to an amplifier. With four sheets, the two innermost sheets form a bilaminate subassembly similar to the 2-sheet embodiment. The outer sheets have metallized outer surfaces which are grounded. Between said outer sheets and the bilaminate subassembly, guard rings coaxial with the piezoelectric active areas are provided. The guard rings can be driven electrically in a manner to eliminate the effects of the capacitance of the electrical leads.

8 Claims, 9 Drawing Figures

ACOUSTICALLY TRANSPARENT HYDROPHONE PROBE

This is a division of application Ser. No. 210,044 filed Nov. 24, 1980, now U.S. Pat. No. 4,433,400.

FIELD OF THE INVENTION

This invention relates to hydrophones, and more particularly to hydrophones employing piezoelectrically active elements of the polymer membrane type which possess the property of nearly complete acoustical transparency.

BACKGROUND OF THE INVENTION

The prior art of probing ultrasonic fields in liquids involves the use of miniature hydrophones consisting typically of a small crystalline or ceramic piezoelectrically active element, which is mounted together with suitable backing at the end of a tube or needle, or other similar supporting structure. Despite their small size, such hydrophones unavoidably alter the acoustic field at the probed point because of the large difference in acoustic impedance between the hydrophone materials and the liquid medium in which the hydrophone is immersed during use. Furthermore, material and geometric factors of the sensing element and supporting structure lead to multimode response, undesirable reflections and a complicated frequency and angle dependence of the response.

SUMMARY OF THE INVENTION

The probe device of the present invention is intended to eliminate or substantially reduce the above problems of the prior art devices. Because the supporting structure, in the case of the devices of the present invention, is outside the beam, there are no significant reflections, and there is no significant response from unwanted modes. In particular, the response to normally incident plane wave fields is essentially independent of frequency below the thickness resonance frequency of the polymer membrane, which makes the device of the present invention useful as a standard hydrophone against which the frequency response of other hydrophones can be compared.

A device according to the present invention consists of a hydrophone with the property of nearly complete acoustical transparency. Because of this property, the probe can measure the spatial distribution (with high resolution) and the temporal variation (over a broad bandwidth extending to about 200 MMz) of the acoustical pressure in a fluid medium such as water or oil, or in biological tissue, without significantly altering the acoustical pressure at the point probed, or in its vicinity, or in the case where the sound field is confined within a finite size acoustic beam, without altering significantly the acoustic pressure anywhere in the medium. The acoustic transparency is achieved by making the sensitive part of the probe an integral small central part of a large continuous sheet of a piezoelectric polymer, such as polyvinylidene fluoride which can be rendered locally piezoelectric and having an acoustic impedance which is similar to that of the medium in which the probe is immersed. Electrodes on both sides of the sensitive part and electrical leads from the sensitive part to a suitable amplifier or transmission line spaced from the probed region are provided by thin metallic coatings deposited on both sides of the polymer film.

The small active area is rendered strongly piezoelectric by a poling process involving the temporary application of a voltage across electrodes which have been previously deposited on the opposite surfaces of the polymer film or sheet. A typical procedure used to pole the herein-described probes consists of maintaining a nominal applied field of e.g. 1 MV/cm while the polymer is brought to a temperature of e.g. 390 K for e.g. 15 minutes and then is brought back to room temperature. It is possible to prepare a sheet with significant piezoelectric activity confined within one or more very small areas, defined by the electrode pattern.

In one embodiment of the present invention, the sheet takes the form of a flat membrane held taut by means of a hoop or other convenient supporting structure, which is made sufficiently large so as to remain, during use, outside the region of the medium sustaining acoustic wave fields and adequately spaced far away from the field point probed. The electrodes have the form of circular spots and the electrical leads have the form of fine lines. In cases where the acoustic field is confined within a collimated beam, the probe is oriented so that the membrane is perpendicular to the beam. In such cases, the only part of the probe which lies in the acoustic field is the thin polymer membrane with negligibly thin coatings serving as electrodes and electrical leads. Since these present a negligible acoustic impedance discontinuity, the membrane is highly acoustically transparent at the frequencies used, and the sound field in the presence or absence of the hydrophone probe is essentially the same. Similarly, because the membrane is acoustically homogeneous over its surface, mechanical scanning movement of the probe across the acoustic beam does not change the impedance seen by the source of the acoustic beam, and the spatial distribution of the acoustic pressure remains independdent of the position of the probe during a scan.

An extended embodiment of the present invention uses two separate membranes bonded or fused together with their separate piezoelectrically sensitive areas and electrodes in juxtaposition in such a manner that electrodes in contact have the same polarity during poling. This design allows the outermost surfaces to be coated over their entire area with a conductive film so that these surfaces can be operated at a common ground potential electrically, while the innermost electrodes, together with an electrical lead in the form of a fine line, which are in effect reduced to a single electrode and electrical lead by virtue of their intimate contact, are shielded from electrical fields by the outer electrodes. This extended embodiment, used in conjunction with a coaxial signal cable, has the additional feature of having high immunity from pickup of electrical noise including the emissions from the acoustic projector, which emissions, in the absence of such shielding, tend to be coupled capacitively to the hydrophone probe.

A further extension of the present invention uses two additional membranes, for a total of four. In this further embodiment, the two innermost membranes are first bonded or fused together with the piezoelectric parts, electrodes, and leads juxtaposed, as in the previous embodiment, The outer surfaces of this bilaminate assembly are coated with a conducting thin film shaped to form a guard ring around the sensitive area and extending as a guard strip opposite the inner electrical lead adjacent thereto. An additional membrane, acting as a spacer, is then bonded or fused to each side of the bilaminate assembly, and the outer surfaces thereof are coated with a conducting thin film. In this embodiment, the intermediate coatings serve as guard electrodes and the outermost electrodes serve as a common ground, as before. The guard electrodes can be driven electrically so that the potential of the guard is maintained equal to the potential of the center electrode at all times for all frequencies of interest. This extended embodiment, when used with the guard driven, has the additional advantage that the capacitance of the electrical leads is in effect eliminated. This embodiment is most useful when the sensitive area is smaller than 1 mm in extension or diameter, in which case the probe capacitance is small (less than 1 pF) and the loading effect of the capacitance of the electrical leads (greater than 10 pF) would be considerable without the provision of the guard which can be driven electrically. The conductive coatings mentioned herein can be vacuum-deposited metal, such as aluminum, gold preceded by chromium, or indium. When aluminum is used as the outermost coating, an overcoating of the polymer Parylene (made by Union Carbide Corp.) is preferably also applied by vapor deposition and polymerization. This overcoat prevents the slow deterioration and disintegration of the aluminum through chemical reaction with contaminants in the water.

The interrelationship between the piezoelectric activity, the stability, the pretreatment (annealing and stretching) and the poling parameters (poling voltage, poling time, and poling temperature) for commonly available materials in particular thicknesses is discussed, for example, in J. M. Kenney and S. C. Roth, J.Res.-Nat.Bur. Stand., 84, 447 (1979).

Accordingly, a main object of the invention is to provide an improved hydrophone device which overcomes the disadvantages and deficiencies of the hydrophone probe devices of the prior art.

A further object of the invention is to provide an improved piezoelectric hydrophone probe device which has the property of nearly complete acoustic transparency.

A still further object of the invention is to provide an improved hydrophone device which does not alter the acoustic field at the probed point due to any difference in acoustic impedance between the hydrophone materials and the liquid medium in which the hydrophone device is immersed, and which does not lead to multimode response or undesirable reflections, and which does not produce complicated frequency and angle dependance in its response.

A still further object of the invention is to provide an improved hydrophone device which has nearly complete acoustic transparency and which can be employed to measure the spatial distribution with high resolution and the temporal variation over a broad bandwidth of the acoustic pressure in a fluid medium or in biological tissue, without significant alteration of the acoustic pressure at the point probed or in its vicinity, or in a case where the sound field is confined within a finite-size beam, without significant alteration of the acoustic pressure anywhere in the medium.

A still further object of the invention is to provide an improved hydrophone device employing as a main component a relatively large continuous sheet of piezoelectric polymer which has been rendered locally piezoelectric, which has an acoustic impedance which is similar to that of the medium in which the device is to be immersed, and which includes means to hold the sheet taut, the holding means being sufficiently large so as to remain during use, outside of the acoustic wave fields being probed and spaced relatively far from the field point probed, and wherein mechanical scanning movement of the probe does not change the impedance seen by the acoustic beam source, and wherein the spatial distribution of the acoustic pressure remains independent of the position of the probe during a scan.

Another object of the invention is to provide hydrophone array devices with a suitable pattern of piezoelectrically active regions acting independently of each other and in a non interfering manner, for the purpose of characterizing acoustic fields without scanning or for the purpose of real-time imaging.

BRIEF DESCRIPTION OF THE DRAWINGS

Further objects and advantages of the invention will become apparent from the following description and claims, and from the accompanying drawings, wherein:

DESCRIPTION OF PREFERRED EMBODIMENTS

Figure 1:
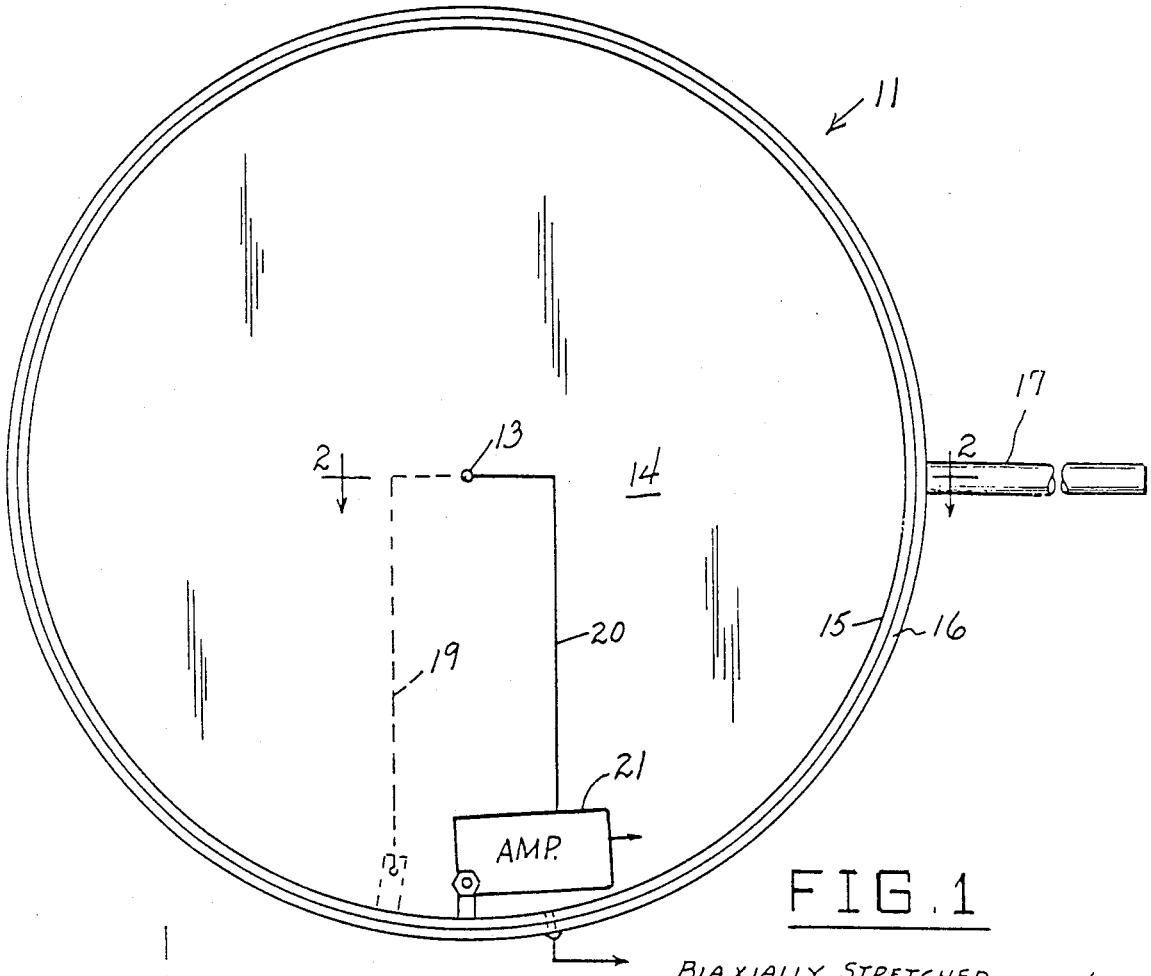
FIG. 1 is a bottom plan view of an improved hydrophone device constructed in accordance with the present invention.

The hydrophone probes described herein utilize the combined piezoelectric and acoustic properties of certain semicrystalline polymers such as polyvinylidene fluoride ($PVF_2$ or PVDF), polyvinyl fluoride (PVF), and copolymers of vinylidene fluoride with tetrafluoroethylene $P(VF_2\text{-}TFE)$ or with trifluoroethylene P(VFhd 2-TRFE). These polymers are available in or can be made into sheets ranging in thickness from a few to several hundred micrometers and any can be used depending on the wavelength of the ultrasound to be measured. Electrodes can be deposited on the surfaces of these sheets in almost any desired pattern by straightforward vacuum coating methods. The parts of the sheets covered on both sides by electrodes can be rendered strongly piezoelectric by a poling process, above mentioned, involving the temporary application of a voltage across these electrodes. The procedure used to pole the probes may consist of maintaining a nominal applied field of 1 MV/cm while the polymer is brought to a temperature of 390 K for 15 minutes and then returned to room temperature although other poling procedures may be used. Because on a microscopic scale poling requires that the electric field exceed a ferroelectric switching field close to 1 MV/cm, negligible poling occurs outside the high field region between opposite electrodes. It is thus possible to prepare a sheet with significant piezoelectric activity within one or more small areas defined by the electrode pattern.

The spot poled, biaxially stretched polymer sheet can be held in the form of a taut, flat, and mechanically stable membrane by means of a convenient supporting structure such as a hoop. With suitable electrical leads, the assembly constitutes a detector of acoustic pressure which is essentially free of radial and other types of undesirable modes of resonance commonly found in miniature hydrophones. The tautness of the membrane, which is essential to eliminate certain undesirable modes and to insure reliable performance in other respects, is maintained indefinitely when biaxially stretched polymer is used. This is because relaxation processes tend to return the polymer to the smaller surface area it had before it was stretched. Thus, an insufficiently tensioned membrane will become taut after it is temporarily heated to accelerate the relaxation processes.

Because of the similarity in acoustic impedance between polymeric materials and the liquids commonly used in ultrasonic testing, a poled polymer sheet used as a hydrophone is highly transparent to ultrasound up to frequencies of several MHz. When spot poled, it therefore becomes a nearly nonperturbing probe. To take the fullest possible advantage of this acoustical transparency, the supporting structure for the polymer sheet must be kept suitably far removed from the region probed. This requirement is achieved by making the diameter of the hoop several times as large as the diameter of the acoustic beams likely to be encountered.

Polymer probes of the type described herein thus have two major performance characteristics not shared by the minature hydrophones previously used: (1) They can measure the acoustic pressure at a point without perturbing significantly either the local acoustic pressure or the acoustic pressure distribution prevailing in the absence of the probe; and (2) when a probe is scanned across a beam, the already small impedance perturbation of the probe remains constant during the scan, so that the load impedance seen by the source of the ultrasound is also constant.

One disadvantage of single-sheet polymeric probes is that they are not inherently shielded from radio frequency interference. Such probes may, for instance, pick up a strong "main-bang" signal when used in pulse-echo studies. While such interference signals can normally be eliminated by using conventional gating techniques, a design method for electrically shielding the probe is desirable to suppress these and other spurious signals. This can be accomplished by using a bilaminate design which, as indicated below, is compatible with coaxial signal transmission. This design for use in the 1–10 MHz range, like the single sheet design, may employ 25 $\mu$m thick $PVF_2$. The total thickness of about 50 $\mu$m still provides a satisfactory compromise between sensitivity, bandwidth, and acoustic transparency. The bilaminate structure not only provides the possibility of metallizing all external surfaces which can then be grounded, but also is intrinsically a noise-cancelling design.

Referring to the drawings, and more particularly to FIGS. 1 to 4, 11 generally designates a single-sheet piezoelectric polymer probe with the electrode pattern deposited on each side, said pattern comprising the opposing electrodes 12, 13 centrally deposited on the piezo-electric sheet, shown at 14. The sheet 14 is clamped between inner and outer relatively rigid hoop rings 15 and 16 and held taut thereby. A radially extending supporting rod 17 is rigidly secured to the outer hoop ring 16.

Figure 4:
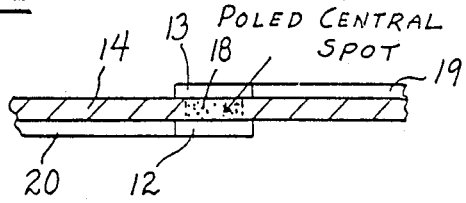
FIG. 4 is an enlarged fragmentary cross-sectional view taken substantially on line 4—4 of FIG. 3.

The diameter of the active area, shown at 18 in FIG. 4, may be approximately 0.5 mm. The thickness of the deposited electrodes 12, 13 may consist respectively of 0.2 micrometers of gold on 0.02 micrometers of chromium. This combination forms a highly stable electrode in water. Aluminum can be used alternatively. The electrodes 12, 13 have respective integrally deposited electrical leads 19, 20.

The electrodes 12, 13 and their leads 19, 20 may be deposited on the polymer sheet 14 by vacuum evaporation from a tungsten filament through a metallic mask. To insure good edge definition of the electrodes and leads, the mask may be of iron foil so that when used with a magnetic substrate, with the polymer to be coated in between, it is attracted magnetically to the substrate and pressed tightly against the polymer. The electrode pattern may be produced in the mask photolithographically.

The hoop rings 15, 16 may be machined of brass to dimensions such that the diametric clearance between the inside and outside loops is equal to the thickness of the membrane 14.

Figure 2:
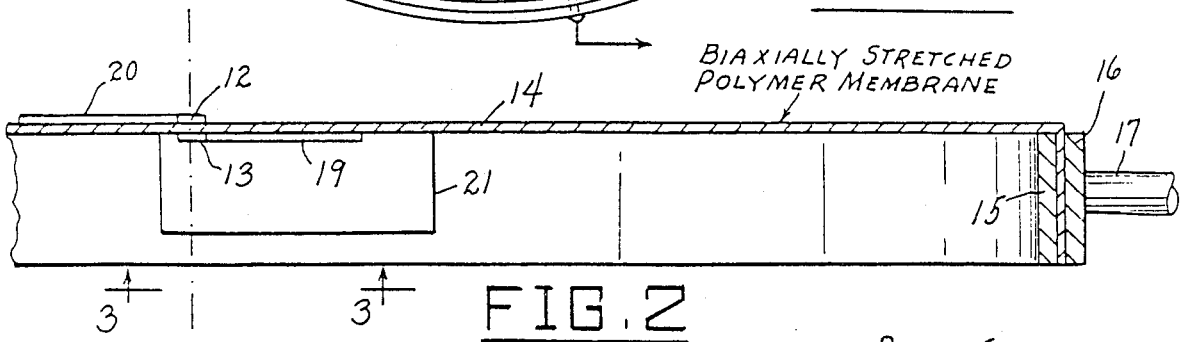
FIG. 2 is an enlarged vertical cross-sectional view, with the thicknesses of some parts exaggerated, taken substantially on the line 2—2 of FIG. 1.
Figure 3:
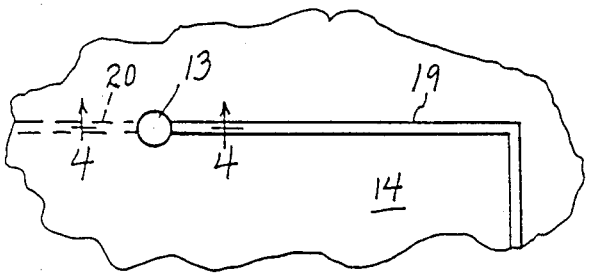
FIG. 3 is an enlarged fragmentary plan view taken substantially on line 3—3 of FIG. 2.

The desirability for preamplification of the signal as close as possible to the hydrophone becomes important as the size of the active area 18 decreases and the capacitance falls to a few picofarads or less. In FIGS. 1 and 2 an FET follower amplifier 21 is shown mounted just inside the hoops. Electrical connections thereto of the deposited leads 19, 20 may be made in any suitable manner, for example, by employing conductive epoxy material. The amplifier assembly 21 is suitably potted, for example, in silicone rubber. A typical probe may be about 7 cm in total diameter.

Figure 5:
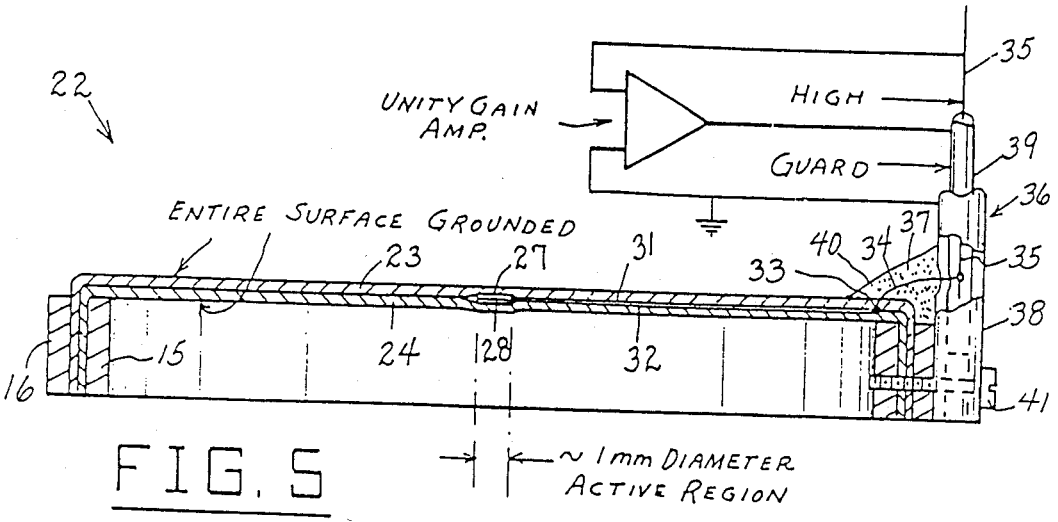
FIG. 5 is a vertical cross-sectional view taken diametrically through a modified form of hydrophone probe device according to the present invention, again with the thicknesses of some parts exaggerated.
Figure 6:
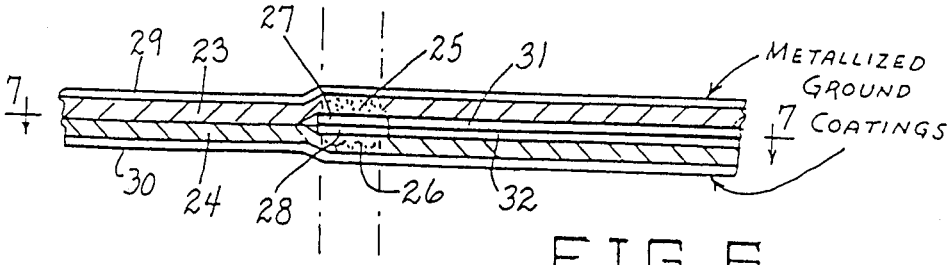
FIG. 6 is an enlarged fragmentary vertical cross-sectional view taken through the center portion of the probe device of FIG. 5.
Figure 7:
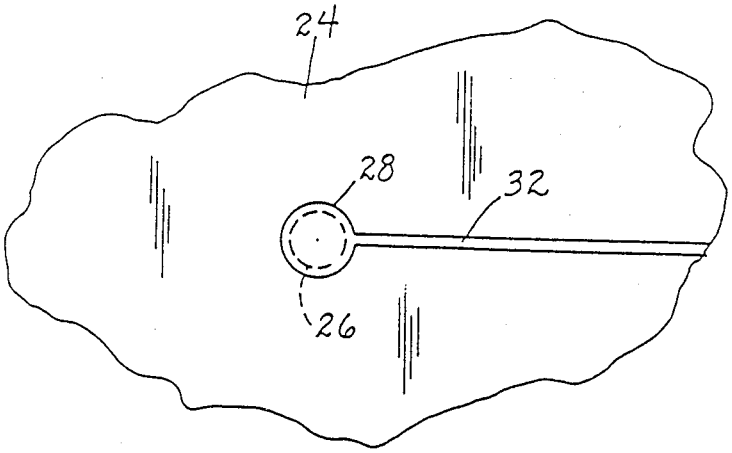
FIG. 7 is a fragmentary horizontal cross-sectional view taken substantially on line 7—7 of FIG. 6.

FIGS. 5, 6 and 7 illustrate an embodiment in the form of a bilaminate probe structure, designated generally at 22, comprising two identical polymer membranes 23, 24 bonded together. Said membranes are clampingly secured between inner and outer hoop rings 15, 16 and held taut thereby. Each polymer membrane has a poled central spot, forming the respective piezoelectric active areas 25, 26 shown in FIG. 6. The membranes are provided with abutting respective central positive electrodes 27, 28 about 1 mm in diameter or suitably smaller and with opposite metallized ground plane coatings 29, 30. The ground plane coatings are deposited after poling and form extended negative electrodes. An electrode pattern similar to that of the previously described embodiment is used for each membrane during poling, so as to confine the poling field to the central spot. Respective thin strips 31, 32 approximately 200 $\mu$m wide or suitably narrower extend from the central positive electrodes 27, 28 to a common connection junction 33 near the perimeters of the membranes, and serves as an electrical signal lead as in the single-layer embodiment previously described. The electrodes 27, 28, leads 31, 32 and ground plane coatings 29, 30 may be aluminum films about 0.2 micrometers thick.

The two laminae 23, 24 may be bonded together using slow curing, low viscosity epoxy, preferably degassed under vacuum prior to application. The assembly halves may be kept in a hydraulic press until curing of the epoxy. A thin wire 34 is employed to connect the junction 33 to the center conductor 35 of a triaxial transmission line 36 and may be cast or embedded in place by epoxy 37, or the like, as shown in FIG. 5.

The transmission line 36 is provided with a thin-walled stainless steel tube 38 serving as the outer conductor through which the insulated guard sleeve 39 and further-insulated center conductor 35 concentrically pass. The outer conductive tube 38 is connected to the ground-plane aluminum coatings 29, 30 by a layer 40 of silver-bearing paint on the epoxy mass 37, and also by a metal fastening bolt 41 extending through the empty lower portion of the transmission line outer tube 38 and threadedly engaged through the clamping hoop rings 16, 15, as shown in FIG. 5. This arrangement therefore connects the piezoelectric laminae 23, 24 electrically in parallel and mechanically in series.

The bilaminate structure of FIGS. 5 to 7, described above, has three important properties: (1) The capacitance of the active region is twice that of the single layer probe having the same active area. (2) The outer surfaces form a grounded enclosure acting as an effective shield from stray electric fields. (3) The orientations of the polarization in the two halves are opposed such that stray electric fields leaking through the grounded surfaces appear 180° out of phase electrically and cancel to a first approximation.

The triaxial transmission line allows the amplifier to be mounted away from the probe and above the liquid level. During normal operation, the loading effects of the cable capacitance are essentially eliminated by using the intermediate conductor 39 of the triaxial line as a driven guard. A unity-gain operational amplifier circuit is used to maintain the guard sleeve 39 at the same potential as the center conductor 35 over the frequency bandwidth of interest. Other circuits controlling the amplitude and phase of the signal applied to the guard sleeve 39 may be employed to provide electronic control of the signal amplification or of the shape of the frequency response.

To protect the exposed aluminum coatings, the hydrophone may be finally coated with the semicrystalline polymer Parylene by chemical vapor deposition and simultaneous polymerization. The thickness of Parylene is approximately 10 micrometers on all surfaces.

Figure 8:
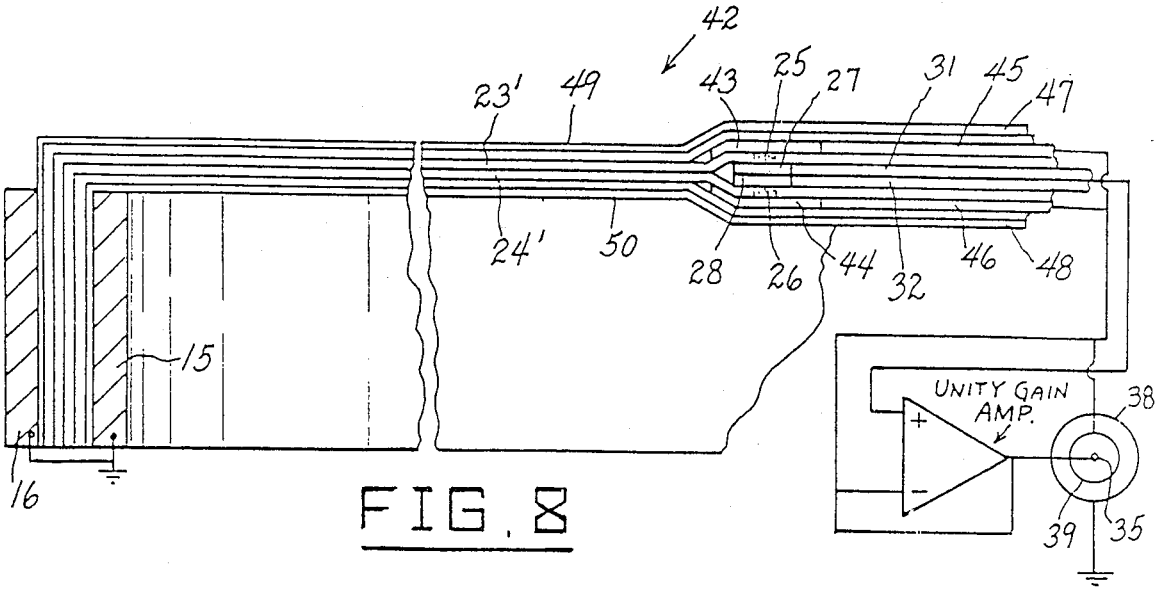
FIG. 8 is an enlarged fragmentary diametral vertical cross-sectional view, with the thicknesses of some parts exaggerated, taken through still another embodiment of a hydrophone probe device according to this invention, employing four membranes.
Figure 9:
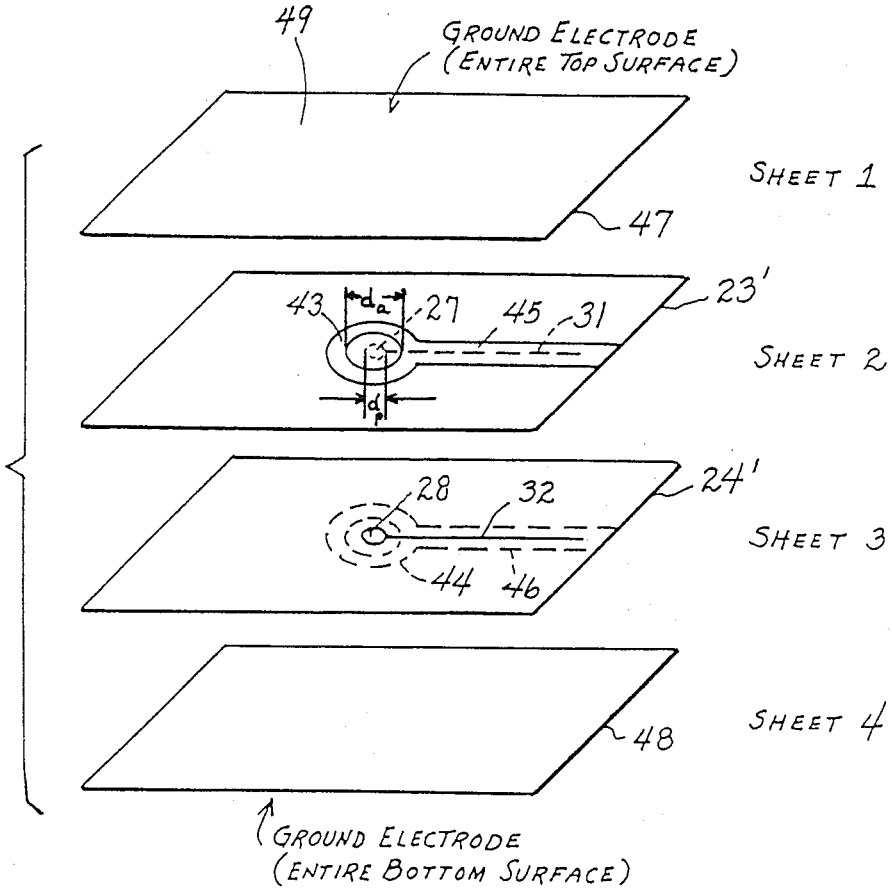
FIG. 9 is a diagrammatic perspective exploded view illustrating the relative arrangement of the four membranes employed in the embodiment of FIG. 8.

FIGS. 8 and 9 illustrate a further embodiment of the present invention, designated generally at 42, which employs two additional membranes, for a total of four. In this embodiment the two innermost membranes, shown at 23' and 24', are first bonded or fused together with the piezoelectric parts, electrodes, and leads juxtaposed, as in the bilaminate embodiment of FIGS. 5 to 7. The outer surfaces of this bilaminate assembly are coated respectively with conducting thin films shaped to form guard rings 43, 44 around the respective sensitive areas 25, 26, and guard strips 45, 46 for the respective electrical leads 31, 32, the ring 43 and strip 45 being located over electrode 27 and lead 31, and the ring 44 and strip 46 being located beneath the electrode 28 and 32, as viewed in FIGS. 8 and 9. Additional respective polymer membranes 47 and 48 are then bonded or fused to the outer sides of the bilaminate assembly, and the outer surfaces of the membranes 47 and 48 are coated respectively with conducting thin films 49 and 50. In this embodiment the intermediate coatings 43, 45 and 44, 46 serve as guard electrodes and the outermost electrode surfaces 49, 50 serve as a common ground, as in the embodiment of FIGS. 5 to 7. The guard electrodes 43, 45 and 44, 46 can be driven electrically, as above described, so that the potentials of the guard electrodes are maintained equal to the potential of the center electrode 27, 28 at all times for all frequencies of interest. This extended embodiment, when used with the guard driven, has the additional advantage that the capacitance of the electrical leads in in effect eliminated. This embodiment is most useful when the sensitive areas 25, 26 are smaller than 1 mm in extension or diameter, in which case the probe capacitance is small (less than 1 pF) and the loading effect of the capacitance of the electrical leads (greater than 10 pF) would be considerable without the provision of the guard assembly, which can be driven electrically. The conductive coatings employed herein may be vacuum-deposited aluminum, gold preceded by chromium, or indium. When aluminum is used as the outermost coating, an overcoating of the polymer Parylene is also applied by vapor deposition and polymerization, to prevent the slow deterioration and disintegration of the alumimun through chemical reaction with contaminants in the water.

In FIGS. 8 and 9 the sensitive areas 25, 26 are shown along with the abutting electrodes 27, 28, and the guard rings 43, 44. In FIG. 9, the inner diameter of the guard ring 43, called $d_a$, is shown to be larger than the diameter of the sensitive area 25/electrode 27 combination, called $d_p$. Area 25 is not shown in FIG. 9, but can be understood to be the poled portion of the polymer sheet directly above 27. The same is true for 44 and 26/28 on sheet 3. As explained herein, a key feature of this design is that is permits elimination of the capacitance of the leads 31, 32 by use of a driven guard arrangement.

It thus follows in a straightforward manner that if $d_a$ is made smaller than $d_p$, this same electrical "neutralizing" effect occurs, resulting in the sensitive area being determined not by $d_p$ but by $d_a$. In other words, a direct consequence of this extended guard design is that the effective size of the sensitive area is controlled by $d_a$ or $d_p$, whichever is smaller. As an extreme example, even if the entire sheets 2 and 3 were poled, only that portion of the sheets where an opening in the guard exists (i.e., $d_a$) would be sensitive. Further, because of fringe poling fields, it should be easier to fix the size of the sensitive area using $d_p$ rather than $d_a$ as the controlling dimension.

These advantages derive directly from the extended guard ring design of the four-sheet hydrophone of FIGS. 8 and 9.

To obtain the requisite edge definition of the electrode and electrical lead pattern for very small (e.g., 250 $\mu$m) diameter piezoelectric sensitive areas and electrodes, and very narrow leads (less than 50 $\mu$m), the following procedures may be used: A mask is first made of a magnetic foil through which the desired pattern is etched by photolithography. A polymer membrane is then sandwiched between the mask and a strongly magnetized substrate which draws the mask tightly against the polymer. The assembly is then placed in a vacuum chamber where the metal is deposited through the mask onto the polymer.

The present invention is also intended to cover patterns deposited on the polymer forming multiple-element hydrophones, such as arrays of points, or arrays of parallel line elements, or arrays of annular elements, or other planar arrays. Additionally, the high acoustical transparency allows the arrangement of a set of appropriately spaced planar arrays to act as a three-dimensional array.

It has been found that the use of biaxially oriented polymer is essential, both to attain high mechanical strength in all directions, and to achieve a stable taut membrane which is free of extraneous modes. It has also been found that the tautness of the membrane, which is essential to eliminate certain undesirable modes and to insure reliable performance in other respects, is maintained indefinitely when biaxially oriented polymer is used. This is because relaxation processes tend to return the polymer to the smaller surface area it has before it was stretched.

While certain specific embodiments of improved hydrophone probes have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

We claim:

1. A hydrophone device comprising supporting hoop means of a selected area, sheet means of biaxially oriented polymer material secured in said hoop means and held thereby in a taut condition, said polymer sheet means having a poled piezoelectric area of predetermined size, the selected area of said sheet means defined by said hoop means being larger than the size of said poled piezoelectric area, and said poled piezoelectric area being located in said sheet means in spaced relation to said hoop means such that said hoop means during use remains outside the region of the medium subjected to the acoustic energy and the point being probed by said hydrophone device, said sheet means having electrode means of deposited metal on one side of said poled piezoelectric area, and guard ring means of deposited metal on the other side of said piezoelectric area, said guard ring means being substantially coaxial with said electrode means, said sheet means having a thickness selected such that it is substantially acoustically transparent in liquid, and respective electrical leads of deposited metal on said sheet means, connected to said electrode means and guard ring means and extending toward the periphery of said sheet means, said deposited electrode means, guard ring means, and electrical leads comprising metal films having thicknesses selected such that the electrode means, guard ring means, and electrical leads do not affect the acoustical transparency of said sheet means, wherein said sheet means comprises two identical polymer membranes bonded together defining respective piezoelectric laminae and being provided with abutting deposited electrodes smaller than about 1 mm in diameter, the two membranes each having a poled piezoelectric area adjacent said abutting deposited electrodes, and said piezoelectric area being oppositely poled, whereby the piezoelectric laminae are electrically connected in parallel, wherein said electrical leads connected to said abutting deposited electrodes include respective superimposed strips of deposited metal between the two membranes, having a common center connection junction near the perimeters of the membranes, and wherein said electrical leads connected to said guard rings include strips of deposited metal on the outer surfaces of the two membranes adjacent said superimposed strips in electricaly shielding relation thereto, having a common guard connection junction near the perimeters of the membranes, and wherein said sheet means also comprises two additional polymer membranes bonded to the outer surfaces of said two identical polymer membranes and having outer metallized surfaces defining ground electrodes, a triaxial transmission line secured to said hoop means, said transmission line having an outer conductor sleeve, a guard sleeve and a center conductor, means connecting said common connection junction to said center conductor, means connecting said common guard connection junction to said guard sleeve, and means connecting said ground electrodes to said outer conductor sleeve.

2. The hydrophone device of claim 1 and wherein said deposited electrode means and electrical leads comprise metal film which are approximately 0.2 micrometers in thickness.

3. The hydrophone device of claim 1 and wherein said poled piezoelectric areas are each approximately 0.5 mm in diameter.

4. The hydrophone device of claim 1 and wherein said sheet means comprises semicrystalline polymer sheet material of the group comprising polyvinylidene fluoride and copolymers of vinylidene flouride with tetrafluoroethylene or trifluoroethylene.

5. The hydrophone device of claim 1 and wherein said poled piezoelectrid areas are located substantially centrally of said sheet means.

6. The hydrophone device of claim 5 and wherein each said sheet means is approximately 25 micrometers in thickness.

7. The hydrophone device of claim 1 further including means to drive said guard sleeve electrically.

8. The hydrophone device of claim 1 and wherein said hoop means comprises inner and outer relatively rigid hoop rings clampingly securing said sheet means therebetween.

9. A hydrophone device according to claim 1, having an array of multiple piezoelectric areas.

* * * * *

UNITED STATES PATENT AND TRADEMARK OFFICE

CERTIFICATE OF CORRECTION

PATENT NO. : 4,517,665

DATED : May 14, 1985

INVENTOR(S) : DeReggi et al.

It is certified that error appears in the above-identified patent and that said Letters Patent is hereby corrected as shown below:

Column 4, line 55, the formula should read: --$P(VF_2$-TRFE)--
line 58, "wavelength" should read --wavelengths-- column 7, line 61, "32" should read --lead 32-- column 8, line 8, "in in" should read --is in--
line 32, "is that is" should read --is that it--
line 55, "procedures" should read --procedure-- claim 2, line 3, "film" should read --films--

Signed and Sealed this

Tenth Day of December 1985

[SEAL]

Attest:

DONALD J. QUIGG

Attesting Officer

Commissioner of Patents and Trademarks